United States Patent [19]

Vinson

[11] 4,307,668

[45] Dec. 29, 1981

[54] TRANSPORTATION SYSTEM UNITIZING PERMANENT MAGNETS FOR LEVITATION OF A VEHICLE

[76] Inventor: Roy D. Vinson, 146 Cottage Dr., Covina, Calif. 91722

[21] Appl. No.: 151,412

[22] Filed: May 19, 1980

[51] Int. Cl.[3] ..... B61B 13/08

[52] U.S. Cl. ..... 104/281; 105/164

[58] Field of Search ..... 104/281–285; 105/164, 197 B, 199 R, 144, 157 R; 267/3, 65 R, 65 D; 180/115, 117

[56] References Cited

U.S. PATENT DOCUMENTS

| | | | |
|---|---|---|---|
| 3,460,485 | 8/1969 | Eastov | 104/293 |
| 4,181,080 | 1/1980 | Miller | 104/281 |
| 4,217,829 | 8/1980 | Heidelberg | 104/281 |

*Primary Examiner*—Richard A. Bertsch

*Attorney, Agent, or Firm*—Allard A. Braddock

[57] ABSTRACT

A vehicle-suspension type of permanent magnet-levitation transportation system has an elevated track structure defining a bed with a ferromagnetic levitation track on the underside thereof and a spaced parallel control track composed of ceramic magnetic material having transverse polarity orientation also running on the underside of the bed. A vehicle for traveling along the track has a series of spaced cobalt-rare earth levitation magnets positioned under the ferromagnetic track and a series of spaced cobalt-rare earth control magnets positioned under the control track in magnetic repulsion mode with the ceramic magnets. In levitated position the attraction of the levitation magnets for the ferromagnetic track is balanced by the repulsion between the control magnets and the ceramic track. Hydraulic, mechanical and electromagnetic means for positioning the levitation and control magnets in proper vertical relationship to maintain levitation of the vehicle are described.

12 Claims, 4 Drawing Figures

TRANSPORTATION SYSTEM UNITIZING PERMANENT MAGNETS FOR LEVITATION OF A VEHICLE

BACKGROUND OF THE INVENTION

Transportation systems which use magnetic fields to provide levitation of a cargo-carrying or passenger-carrying vehicle have been under study and experiment for many years. The IEEE Transactions on Magnetics for September, 1974, pages 397–473, reported on a number of such systems which had been investigated and many of which were under test.

In general, magnetic levitation, sometimes called "maglev", has been of two types. Attractive maglev has used ordinary electromagnets which are attracted to the underside of a ferromagnetic rail without making contact. The magnet current is controlled by solid state amplifiers so as to maintain a clearance gap between the magnet poles and steel rail. Propulsion of levitated vehicles is by linear induction motor or linear synchronous motor.

Repulsion maglev has also been tested. In this form of vehicle levitation, superconducting coils on board the vehicle provide the magnetic field. Lift is produced by repulsion between these superconducting magnets and eddy currents that their moving magnetic fields induce in an aluminum rail structure. The vehicle must be moving at a speed of about twenty miles per hour before the induced eddy currents provide sufficient lift to levitate the vehicle. Obviously, this take-off speed is an objectionable feature of repulsion maglev as is the necessity of packing equipment on board the vehicle to maintain the superconducting condition of the magnet coils.

The use of electromagnets to provide the principal lifting force for a vehicle is at best cumbersome and costly. The present invention is aimed at a system in which permanent magnets will be used to provide most or all of the magnetic strength necessary for both levitation and stability control of the vehicle.

SUMMARY OF THE INVENTION

In this invention an elevated track support structure provides clearance for a vehicle movable along the underside of the structure. Running along the underside of the structure is a levitation track composed of ferromagnetic material and a spaced, parallel control track consisting of ceramic magnets having transverse polaritty orientation. A vehicle on the underside of the support structure has a series of cobalt-rare earth magnets at spaced intervals vertically under the ferromagnetic track and a series of cobalt-rare earth magnets at spaced intervals vertically beneath the ceramic magnet control track, the control magnets being in repulsion mode with respect to the ceramic magnets. The relative vertical position of the levitation magnets and control magnets in response to vehicle load changes and external forces applied to the vehicle is provided by hydraulic means, mechanical means, electromagnetic means, or combinations thereof. In particular cases, the vehicle may consist of a levitation compartment and a cargo or passenger compartment separate therefrom and vertically movable with respect thereto.

DESCRIPTION OF PREFERRED EMBODIMENTS

Figure 2:
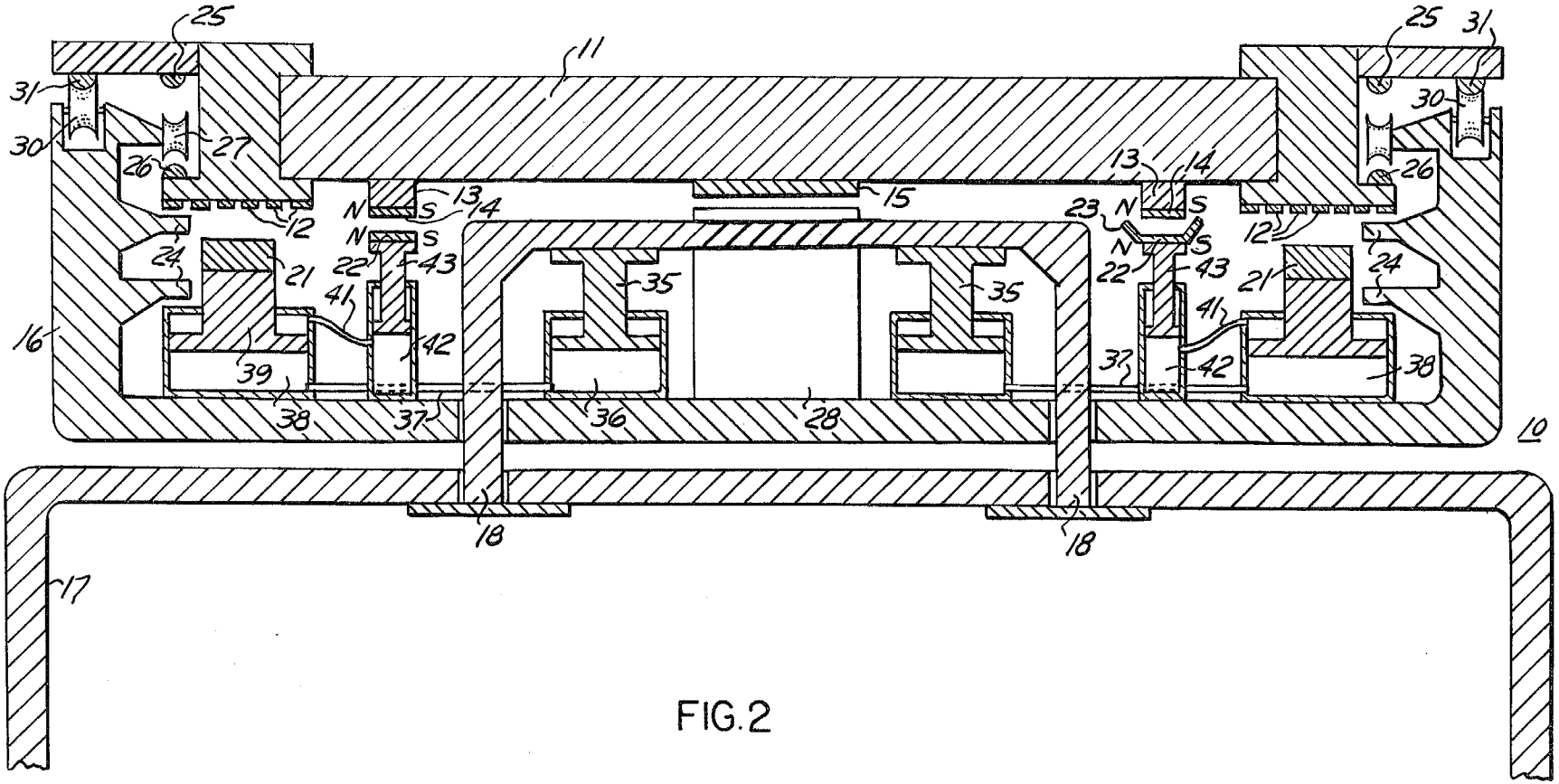
FIG. 2 is a broken sectional view taken along line 2—2 of FIG. 1 with the vehicle positioned on a track section.

As shown particularly in FIG. 2, the transportation system of this invention comprises a vehicle 10 movable along a track structure 11. The vehicle 10 moves on the underside of the track portion of the structure 11; thus, the structure 11 must be given sufficient clearance above grade to allow for unobstructed passage of the vehicle 10.

Running along the underside of the structure 11 is a ferromagnetic track 12 consisting usually of two rail members which are laminated to reduce eddy currents. Running spaced and parallel to the ferromagnetic track 12 on the underside of the structure 11 is a control track 13 consisting of two rail members, the bottom surface of which consists of ceramic magnets 14 with transverse polarity as indicated by the letters "N" and "S". It is the ceramic magnets 14 which provide both levitation and lateral control of the vehicle 10 and it is for this reason that the track which includes these magnets is referred to as the control track. The structure 11 may also include a strip 15 running along the center in parallel with the control track 13 and levitation track 12. This strip, which may be composed of aluminum, may be used for propulsion of the vehicle 10 in a manner to be explainedd hereinafter.

The vehicle 10 includes a levitation compartment 16 and a cargo or passenger compartment 17. A plurality of inverted U-shaped hangers 18 in the levitation compartment 16 have downwardly extending legs on which the cargo compartment 17 is mounted. The legs of the hangers 18 have vertical movement with respect to the levitation compartment 16 and hence the cargo compartment 17 also has vertical movement with respect to the levitation compartment 16.

The levitation compartment 16 contains a series of permanent levitation magnets 21 preferably composed of cobalt-rare earth material although other permanent magnets possessing magnetic strength comparable to cobalt-rare earth magnets could be substituted. The technology of the high-magnetic-strength cobalt-rare earth magnets has been developed to the point where fifty pounds or more of lift can be provided by one pound of magnetic material. Such magnets are commercially available and will not be discussed here as their technology plays no part in the present invention. As shown in FIG. 2 when the vehicle 10 is positioned on the underside of the structure 11 the levitation magnets 21 are vertically beneath the ferromagnetic levitation track 12. It is the attraction between the magnets 21 and levitation track 12 which lifts the vehicle 10 to levitated position.

Also positioned in the levitation compartment 16 are a series of control magnets 22 which are likewise composed of the same material as the magnets 21. From the polarity indicated by the letters "N" and "S", it can be seen that the magnets 22, which are vertically aligned with the ceramic magnets 14 of the control track 13, are arranged in repulsion mode. Thus, the attraction of the levitation magnets 21 for the levitation track 12 is balanced by the repulsion between the magnets 22 and ceramic magnets 14 of the control track 13. Some of the magnets 22 have oblique extensions 23 as may be seen in the case of the control magnet 22 on the right side of FIG. 2. The purpose of the extensions 23 is to stabilize the vehicle 10 against sidewise movement.

On the outside of each of the magnets 21 is an oscillation and vibration damping device 24. These devices are disclosed and claimed in U.S. Pat. No. 3,662,075 of Klaus Kronenberg. They consist of magnets which may be linearly or rotatably moved relative to one another—or a combination of both movements may be used—to provide stabilizing forces to augment the extensions 23 of the magnets 22.

As shown in FIG. 2, the structure 11 also includes emergency protective tracks 25 and 26 with which a pair of wheels 27 can make contact in the event of failure of the control devices to maintain proper levitation. The upper track 25 is positioned to hold the vehicle 10 so as to prevent contact between the magnets 21 and ferromagnetic track 12 in the event the magnets 21 override the downward forces of the magnets 22.

The propulsion strip 15 is used in conjunction with a motor 28 in the levitation compartment 16. The motor 28 may be a linear induction motor or a linear synchronous motor. Such motors are described and claimed in Sawyer U.S. Pat. No. 4,061,089. They are well known in the art and do not constitute a part of this invention. Accordingly, they will not be discussed further herein. In fact, the means of propulsion may also be by a conventional electric motor driving wheels along a track. This is suggested in FIG. 2 by a wheel 30 running along a track 31.

The attraction field provided by the magnets 21 must be very much stronger than the repulsion field provided by the magnets 22 and ceramic magnets 14 since the attraction field must provide sufficient upward force to lift the entire weight of the vehicle 10 plus an additional reserve force to provide a factor of safety whereas the downward force exerted by the repulsion field must balance only the reserve force. This reserve force is very important for it is what provides the factor of safety in the operation of the vehicle. It should be as large as possible within the design parameters available. However, the fact that repulsion control fields are inherently stable whereas attraction levitation fields are not presents the designer with a dilemma. If the vehicle 10 is in stationary levitated position and a downward force on it is generated as by adding weight to the cargo space, the instantaneous response is for the vehicle to move downward and this weakens both the levitation force and the repulsion force since both the levitation and repulsion gaps widen. If the levitation force weakens at the same rate as the repulsion force, or at a greater rate, the vehicle will suffer magnetic dropout and will become stationary only when the wheels 27 encounter the track 26. Accordingly, an unavoidable requirement of a permanent magnet levitation system is that on any downward movement of the vehicle 10 the strength of the repulsion field decline at a faster rate then the levitation field.

If the vehicle 10 is in stationary levitated position and there is a decline in its weight as by the removal of some of the cargo, there will be an instantaneous upward movement of the vehicle and both the levitation and repulsion fields will increase in intensity. If both fields increased at the same rate there would be nothing to stop upward movement of the vehicle until it came to rest with the wheels 27 on the tracks 25. In order to prevent this, it is necessary that the repulsion field increase at a rate faster than the levitation field. Thus, it can be seen that the repulsion field must increase faster than the levitation field during upward movement of the vehicle 10 and decrease faster during downward movement of the vehicle in order for the system to function effectively.

It was pointed out above that the factor of safety of the system is provided by the strength of the repulsion field. If design requirements call for a vehicle having a maximum weight, including cargo, of, for example, 10,000 pounds, the levitation magnets 21 must be able to lift 10,000 pounds when the vehicle is at rest on the track 26 and an additional weight of, for example, 1,500 pounds when the vehicle is in levitated position with an air gap of four centimeters between the magnets 21 and track 12. In this position the levitation magnets 21 are exerting an upward force of 11,500 pounds and the vehicle 10 is exerting a downward force of 10,000 pounds. Accordingly, the control magnets 22 must produce a repulsion field exerting a downward force of 1,500 pounds in order to maintain static balance. This 1,500-pound downward force is the stabilizing and safety factor and it is to be noted that the gap between the magnets 22 and ceramic magnets 14 to produce this downward force will always be the same although there will be momentary changes in the gap whenever the weight in the vehicle is changed. It should also be noted that as the weight in the vehicle is increased the gap between the levitation magnets 21 and track 12 will be smaller once equilibrium is restored and as the vehicle weight is reduced this gap will be increased upon restoration of equilibrium.

The operating requirements which the levitation system of this invention must meet are set forth above. Several structures which will meet the requirements are described hereinafter.

FIG. 2 illustrates the use of hydraulic cylinders and pistons to control vertical movements of the magnets 21 and 22 in response to load changes in the cargo compartment 17 of the vehicle 10. Let it be assumed that cargo is added to increase the weight of the cargo compartment 17. In response to this weight increase, a pair of pistons 35 associated with cylinders 36 push downward to force hydraulic fluid through a pair of tubes 37 to a pair of cylinders 38. The addition of hydraulic fluid to cylinders 38 exerts an upward push on a pair of pistons 39 on which the levitation magnets 21 are mounted. This narrows the levitation gap slightly enabling the levitation fields to increase the upward force on the vehicle 10. At the same time a quantity of hydraulic fluid on the upper side of the pistons 39 is forced through the tubes 41 to a pair of cylinders 42. This produces an upward movement on a pair of pistons 43 on which the magents 21 are mounted. This reduces the repulsion gap slightly thereby increasing the downward force on the vehicle 10 and arresting upward movement of the levitation magnets 21. Downward movement of the pistons 43 continues forcing the back flow of hydraulic fluid through the tubes 41 into the upper portion of the cylinders 38 to impart a slight additional downward movement to the pistons 39 and magnets 21 until an equilibrium point is reached. Thus, the effect of the hydraulically-actuated piston movements is to return the system to equilibrium with the levitation magnets 21 slightly nearer the tracks 12. When the weight of the vehicle 10 is reduced as by removal of a portion of the cargo, the vehicle 10 moves upward and in addition coil springs (not shown), which bias movement of the pistons 35, produce an upward movement of the cargo compartment 17 with respect to the levitation compartment 16 with the result that hydraulic fluid flows from the cylinders 42 to the upper part of the cylinders 38 and from the cylinders 38 to the cylinders 36. When the magnets 22 are restored to equilibrium position the gap between the levitation magnets 21 and track 12 is slightly greater than it was before the reduction in cargo weight.

When the levitation system of this invention is operating, the orientation of the levitation compartment 16 with the track is constant. Under this condition the gap of the repulsion system must also be constant in order to have the downward force provided by the repulsion also a constant. Bearing this in mind, it can be seen that the hydraulic control system can be simplified somewhat by eliminating the tubes 41, fixing the position of the control magnets 22 with respect to the levitation compartment 16, and designing the hydraulic systems for a precise amount of flow of hydraulic fluid under varying load conditions. Thus, if the load in the cargo compartment 17 is increased, both the repulsion and levitation gaps would increase slightly and an amount of fluid proportional to the increased weight would flow from the cylinders 36 to the cylinders 38. This would raise the magnets 21 slightly thereby increasing the levitation force and closing the repulsion gap to restore equilibrium conditions with the magnets 21 slightly closer to the track 12 than before the load change. With a reduction in load, the reverse process would take place with fluid being drawn to the cylinders 36 from the cylinders 38 bringing about a downward movement of the magnets 21. The repulsion gap would first be reduced and then would be restored to return the vehicle to the same position of the levitation compartment 16 with the track 12 that it held before the reduction in load.

Figure 3:
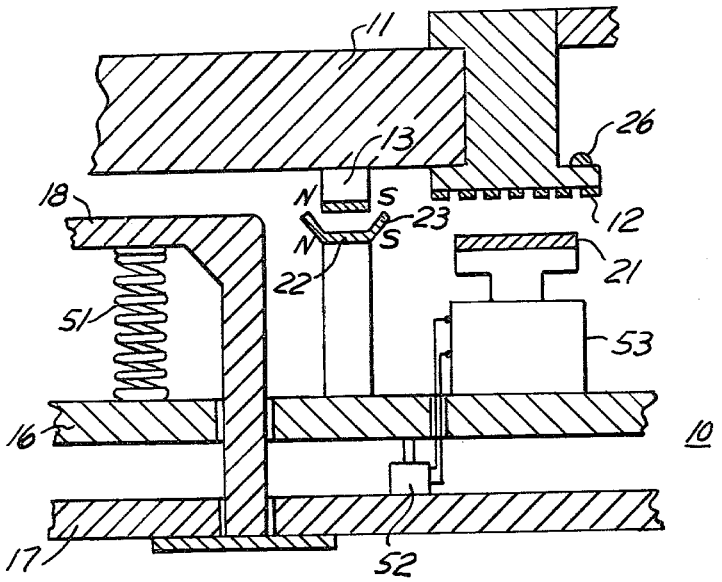
FIG. 3 is a sectional view of an alternative control by mechanical means.

The hydraulic control system of FIG. 2 is essentially a slow-acting system. Slowness is not necessarily a drawback insofar as adjustment to the weight of cargo change is concerned, since such changes would normally take place with the vehicle 10 stopped for loading and unloading and there would be plenty of time for the vehicle to return to equilibrium levitation position. However, in strong, gusty side winds, a vehicle can encounter sudden changes in operating forces while under way and it might be desirable to replace some of the hydraulic control systems of FIG. 2 with faster response systems. FIG. 3 illustrates such a system in which a servo-motor is used to position the levitation magnets 21. While this figure illustrate a single levitation-repulsion unit, it is understood that a number of such units may be used on a single vehicle.

When weight is added to the cargo compartment 17 of the vehicle 10, a coil spring 51 in the levitation compartment 16 is compressed slightly by the additional weight. This increases the vertical distance separating the cargo compartment 17 from the levitation compartment 16 bringing about a corresponding change in the setting of a sensing unit 52 which transmits the degree of change to a servo-motor 53 on which the magnet 21 is positioned. The servo-motor 53 moves the magnet 21 closer to the track 12 a distance corresponding to the increase in distance between the cargo and levitation compartments, the elements being calibrated to achieve this result. The increased magnetic strength in the levitation system now raises the vehicle 10 until the gap initially present in the repulsion system is restored at which point the levitation and repulsion systems are in balance. In the event weight is removed from the cargo compartment, the sensing unit 52 sends a reverse signal to the servo-motor 53 which increases the gap between the track 12 and levitation magnet 21 to a degree corresponding to the reduction in weight. Since the gap in the repulsion system was reduced slightly by the reduction in weight in the cargo compartment, the repulsion system now exerts a downward force on the vehicle 10 until equilibrium position is restored.

Figure 4:
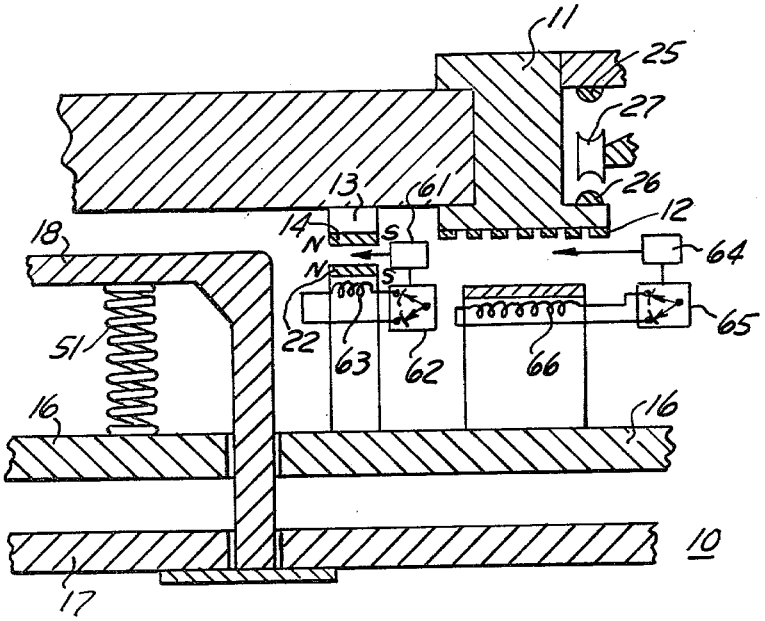
FIG. 4 is a sectional view of an alternative control by electromagnetic means.

In FIG. 4, a very fast-acting levitation control system is illustrated. In this embodiment the principal magnetic strength of both the levitation and control magnetic fields is, as before, provided by permanent magents but these field strengths may be varied by electromagetic fields connected either for flux-aiding or flux-opposing relationship. Both the levitation magents 21 and control magnets 22 may be fixedly positioned with respect to the levitation compartment 16—in which case the cargo compartment 17 may also be fixedly positioned with reference to the levitation compartment 16—or they may be made vertically movable as in the case of the embodiments of FIGS. 1–3. The repulsion control consists of a gap sensor 61 shown in block form which may be mounted on the supporting posts for the magnet 22, a field control 62 responsive to the gap sensor 61, and an electromagnetic coil 63 responsive to the field control 62. The control magnet 22 has a constant-gap neutral or operating position with respect to the ceramic magnet 14 which might produce, for example, a vertically downward thrust of 1,500 pounds on the vehicle 10. If this gap increases as by the addition of weight to the cargo compartment 17, the gap sensor 61 signals the field control 62 which energizes the coil 63 to create magnet flux in opposition to the flux of the permanent magnet 22. This quickly reduces the repulsion field to enable the levitation field to restore the operating gap between the magnets 22 and 14. if the gap is reduced as by the removal of cargo from the cargo compartment 17, the sensor 61 actuates the field control 62 to energize the electromagnet 63 to create a flux field which aids the flux of the magnet 22 thereby increasing the repulsion field to restore the vehicle 10 to operating position.

The levitation magnet 21 has a corresponding control system consisting of a gap sensor 64, a field control 65 and an electromagnetic coil 66. However, it operates in the reverse manner for when the sensor 64 signals an increase in the gap as would occur with an increase in vehicle weight, the field control 65 energizes the electromagnetic winding 66 to create a flux field which aids the flux of the magnet 21 thereby increasing the levitation field and narrowing the gap to restore operating conditions. Should the gap decrease, the reverse action would take place with the electromagnetic coil 66 creating magnetic flux in opposition to that of the magnet 21 equilibrium is once again restored.

The sensing unit 52 of FIG. 3 and gap sensors 61 and 64 of FIG. 4 are shown in schematic form as devices to accomplish their function are available commercially. Hall devices are examples of satisfactory sensing devices. These devices consist of a crystal through which a current is passed. The voltage appearing across the quadrature faces is proportional to a magnetic field in which the crystal is placed and thus will vary according to the position of the sensor in a magnetic gap. This voltage can be used to actuate a linear servo-motor such as motor 53 of FIG. 2 or to energize a field control as illustrated by control 65 of FIG. 4 which controls both magnitude and direction of current actuating the coils 63 and 66.

While the embodiment of FIG. 4 shows controls for both the repulsion and levitation systems, it would be operable with just the levitation control system. It would also be operable with just the repulsion control system provided the orientation of the levitation compartment 16 with the track 12 were allowed to vary slightly. An objection to having the levitation magnet 21 in fixed position with respect to the levitation compartment 16 is that the electromagnetic coil 66 would usually have to be energized during operations. This would not be the case if the electromagnetic system of FIG. 4 were to be combined with the servo-system of FIG. 3. Both systems are entirely compatible and would in effect serve to back up each other.

The limited track structure shown in FIG. 2 will normally be supported by spaced U-shaped inverted U-shaped towers (not shown). By suspending the track structure under the base portion of the U-shaped towers by means of non-rigid members the track structure can avoid serious damage from small earthquakes.

The transportation system of this invention is aimed particularly at high-speed straight-line motion of the vehicle 10 although the track can, of course, have a small curvature. Switching can best be performed by an auxiliary system (not shown) which operates in a manner analogous to a conventional rail system except that the switch does not need to be movable. A conventional type track is emplaced at the switching point underneath the vehicle 10 which is equipped with conventional wheels (not shown) which are aligned with the switch track. The vehicle is lowered onto the switch track by controls (not shown) within the vehicle which is then propelled along the switch track until it engages with its normal trackage in the new direction.

Figure 1:
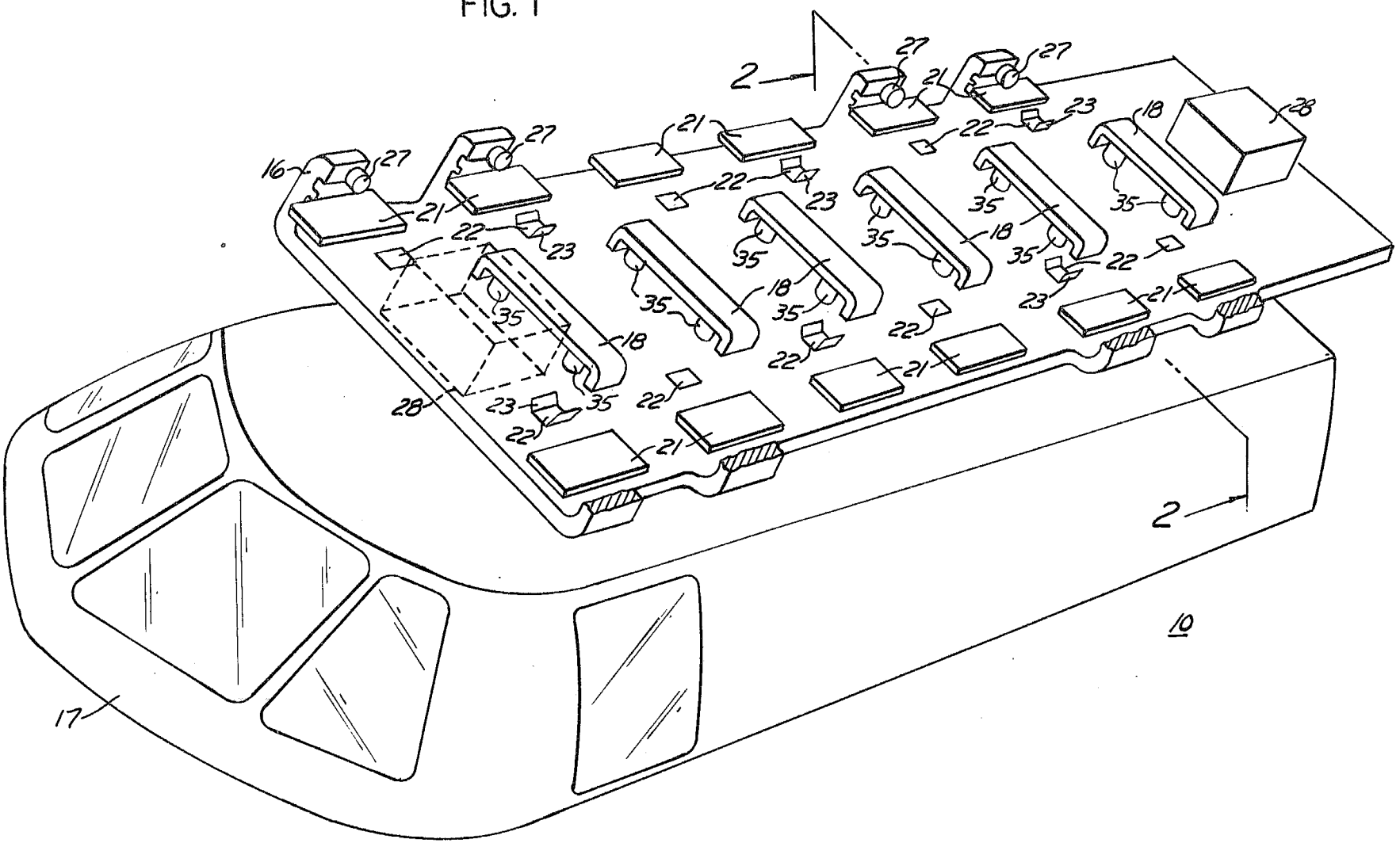
FIG. 1 is a perspective schematic view of a vehicle in accordance with this invention.

FIG. 1 illustrates a vehicle utilizing twelve levitation magnets and a like number of control magnets. Some of these magnets may have control systems as described herein but it is not necessary that all of them have such control systems. Further, it is not necessary to restrict a vehicle to just one of the control systems. The control systems are compatible with each other and may be used on a single vehicle or even a single unit consisting of a magnet 21 and magnet 22. In the embodiment of FIGS. 3 and 4 a single sensor can operate a number of levitation magnets. Accordingly, the invention should not be limited in scope other than as may be necessitated by the scope of the appended claims.

I claim:

1. In a transportation system using magnetic levitation for vehicles:

an elevated track support structure providing clearance for a vehicle movable along the underside of said structure;

a levitation track composed of ferromagnetic material running along the underside of said structure;

a control track composed of ceramic magnet material running on the underside of said structure parallel with and spaced from said levitation track, said control track having transverse polarity orientation;

a vehicle positioned in spaced relation with said levitation and control tracks;

at least one permanent levitation magnet in said vehicle spaced vertically under said levitation track;

at least one permanent control magnet in said vehicle spaced vertically under said control track in magnetic repulsion relationship thereto;

and means for effecting relative vertical movement of said levitation and control magnets to maintain a state of magnetic levitation of said vehicle within a range of changing load conditions in said vehicle.

2. A transportation system as claimed in claim 1 in which the levitation magnet is a cobalt-rare earth magnet.

3. A transportation system as claimed in claim 2 in which each vehicle is equipped with a plurality of spaced levitation and control magnets.

4. A transportation system as claimed in claim 3 in which the levitation and control tracks each consist of two parallel spaced members.

5. A transportation system as claimed in claim 3 in which the levitation magnets include a winding and an energizing circuit connected to said winding for selectively connecting said winding for magnetic flux aiding or magnetic flux opposing relationship.

6. A transportation system as claimed in claim 3 in which the levitation magnets are vertically movable by servo systems in response to the vertical movement of the cargo compartment with respect to the levitation compartment.

7. In a transportation system using magnetic levitation for vehicles:

an elevated track support structure providing clearance for a vehicle movable along the underside of said structure;

a levitation track consisting of two parallel spaced members composed of ferromagnetic material running along the underside of said structure;

a control track consisting of two parallel spaced members composed of ceramic material running on the underside of said structure parallel with and spaced from said levitation track, said control track having transverse polarity orientation;

a vehicle positioned in spaced relation with said levitation and control tracks;

at least one permanent levitation magnet in said vehicle spaced vertically under each of said levitation track spaced members;

at least one permanent control magnet in said vehicle spaced vertically under each of said control track spaced members in magnetic repulsion relationship thereto, and in which the control magnets exert a vertically downward thrust on the vehicle with a force which declines more rapidly than the attraction force between the levitation magnets and levitation track as the gap between the track and magnets increases and in which the control magnets exert a downward thrust on the vehicle with a force which increases more rapidly than the attraction force between the levitation magnets and levitation track as the gap between the track and magnets decreases;

and means for effecting relative vertical movement of said levitation and control magnets to maintain a state of magnetic levitation of said vehicle within a range of changing load conditions in said vehicle.

8. A transportation system as claimed in claim 7 in which the vehicle consists of a levitation compartment and a cargo compartment which have verical movement relative to each other.

9. A transportation system as claimed in claim 8 in which relative movement between the levitation and cargo compartments is spring-biased and in which vertical movement of the control magnets is correlated with vertical movement of the cargo compartment relative to the levitation compartment whereby the addition of weight to the cargo compartment widens the gap between the control magnets and control track and the reduction of weight from the cargo compartment reduces the gap between the control magnets and control track.

10. A transportation system as claimed in claim 8 in which a hydraulic system in the levitation compartment responds to the addition of weight in the cargo compartment to reduce the gap between the levitation magnet and levitation track and responds to the reduction of weight in the cargo compartment to increase the gap between the levitation magnet and levitation track.

11. A Transportation system as claimed in claim 10 in which a hydraulic system unit consists of a vehicle hydraulic cylinder and piston responsive to a change of weight in the cargo compartment, a levitation cylinder and piston hydraulically connected to said vehicle cylinder and responsive to the setting of the vehicle piston to raise a levitation magnet with a cargo weight increase and lower said magnet with a cargo weight decrease and a control cylinder and piston hydraulically connected to said levitation cylinder to raise and lower a control magnet, the hydraulic connection between said levitation cylinder and said control cylinder being on the opposite side of said levitation cylinder piston from the vehicle cylinder hydraulic connection.

12. A transportation system as claimed in claim 11 in which there is a hydraulic system unit for each levitation magnet-control magnet combination.

* * * * *